US006729708B2

(12) United States Patent
Fujii

(10) Patent No.: US 6,729,708 B2
(45) Date of Patent: May 4, 2004

(54) PRINTHEAD AND PRINTING APPARATUS USING SAID PRINTHEAD

(75) Inventor: Yasuo Fujii, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/127,452

(22) Filed: Apr. 23, 2002

(65) Prior Publication Data

US 2002/0158928 A1 Oct. 31, 2002

(30) Foreign Application Priority Data

Apr. 26, 2001 (JP) ..... 2001-130161

(51) Int. Cl.[7] ..... B41J 29/38

(52) U.S. Cl. ..... 347/12; 347/13; 347/211; 347/237; 347/247; 347/168; 347/180

(58) Field of Search ..... 347/9, 12, 182, 347/187, 211, 13, 168, 180, 237, 247

(56) References Cited

U.S. PATENT DOCUMENTS

| | | | | |
|---|---|---|---|---|
| 4,313,124 | A | | 1/1982 | Hara |
| 4,345,262 | A | | 8/1982 | Shirato et al. |
| 4,459,600 | A | | 7/1984 | Sato et al. |
| 4,463,359 | A | | 7/1984 | Ayata et al. |
| 4,558,333 | A | | 12/1985 | Sugitani et al. |
| 4,608,577 | A | | 8/1986 | Hori |
| 4,723,129 | A | | 2/1988 | Endo et al. |
| 4,740,796 | A | | 4/1988 | Endo et al. |
| 5,896,146 | A | * | 4/1999 | Murata et al. ..... 347/42 |
| 5,907,331 | A | * | 5/1999 | Markham ..... 347/12 |
| 6,130,692 | A | * | 10/2000 | Mochizuki et al. ..... 347/57 |
| 2001/0045967 | A1 | * | 11/2001 | Hayasaki ..... 347/9 |
| 2002/0036781 | A1 | * | 3/2002 | Hirayama ..... 358/1.4 |
| 2002/0039117 | A1 | * | 4/2002 | Oikawa ..... 347/14 |

FOREIGN PATENT DOCUMENTS

| | | |
|---|---|---|
| JP | 54-56847 | 5/1979 |
| JP | 59-123670 | 7/1984 |
| JP | 59-138461 | 8/1984 |
| JP | 60-71260 | 4/1985 |

* cited by examiner

*Primary Examiner*—Judy Nguyen
*Assistant Examiner*—Lam S Nguyen
(74) *Attorney, Agent, or Firm*—Fitzpatrick, Cella, Harper & Scinto

(57) ABSTRACT

Printhead structured such that printing elements are divisionally driven in unit of plural blocks, comprises: an input terminal to which printing data and encoded block data are serially inputted; a shift register sequentially shifting and storing one bit at a time the data serially inputted from the input terminal; a latch temporarily storing the data stored in the shift register; a decoder decoding the block data stored in the latch; and an AND circuit. The decoder outputs a signal in which encoded block data is partially decoded, and the AND circuit determines blocks to be driven based on the partially decoded signal. This structure enables to reduce an area of a printhead substrate, thereby enabling cost reduction of a printhead.

22 Claims, 11 Drawing Sheets

FIG. 4

| 4-BIT LATCH OUTPUT | | | | 3-TO-8 DECODER OUTPUT | | | | | | | |
|---|---|---|---|---|---|---|---|---|---|---|---|
| B4L | B3L | B2L | B1L | N8 | N7 | N6 | N5 | N4 | N3 | N2 | N1 |
| * | 0 | 0 | 0 | L | L | L | L | L | L | L | H |
| * | 0 | 0 | 1 | L | L | L | L | L | L | H | L |
| * | 0 | 1 | 0 | L | L | L | L | L | H | L | L |
| * | 0 | 1 | 1 | L | L | L | L | H | L | L | L |
| * | 1 | 0 | 0 | L | L | L | H | L | L | L | L |
| * | 1 | 0 | 1 | L | L | H | L | L | L | L | L |
| * | 1 | 1 | 0 | L | H | L | L | L | L | L | L |
| * | 1 | 1 | 1 | H | L | L | L | L | L | L | L |

* : DON'T CARE

FIG. 5

| AND GATE | ENB | D* | B4LN | B4L | N* |
|---|---|---|---|---|---|
| A1 | 0 | D1 | 1 | 0 | N1 |
| A2 | 0 | D1 | 1 | 0 | N2 |
| A3 | 0 | D1 | 1 | 0 | N3 |
| A4 | 0 | D1 | 1 | 0 | N4 |
| A5 | 0 | D1 | 1 | 0 | N5 |
| A6 | 0 | D1 | 1 | 0 | N6 |
| A7 | 0 | D1 | 1 | 0 | N7 |
| A8 | 0 | D1 | 1 | 0 | N8 |
| A9 | 0 | D1 | 0 | 1 | N1 |
| A10 | 0 | D1 | 0 | 1 | N2 |
| A11 | 0 | D1 | 0 | 1 | N3 |
| A12 | 0 | D1 | 0 | 1 | N4 |
| A13 | 0 | D1 | 0 | 1 | N5 |
| A14 | 0 | D1 | 0 | 1 | N6 |
| A15 | 0 | D1 | 0 | 1 | N7 |
| A16 | 0 | D1 | 0 | 1 | N8 |
| A17 | 0 | D2 | 1 | 0 | N1 |
| A18 | 0 | D2 | 1 | 0 | N2 |
| A19 | 0 | D2 | 1 | 0 | N3 |
| A20 | 0 | D2 | 1 | 0 | N4 |
| A21 | 0 | D2 | 1 | 0 | N5 |
| A22 | 0 | D2 | 1 | 0 | N6 |
| A23 | 0 | D2 | 1 | 0 | N7 |
| A24 | 0 | D2 | 1 | 0 | N8 |
| A25 | 0 | D2 | 0 | 1 | N1 |
| A26 | 0 | D2 | 0 | 1 | N2 |
| A27 | 0 | D2 | 0 | 1 | N3 |
| A28 | 0 | D2 | 0 | 1 | N4 |
| A29 | 0 | D2 | 0 | 1 | N5 |
| A30 | 0 | D2 | 0 | 1 | N6 |
| A31 | 0 | D2 | 0 | 1 | N7 |
| A32 | 0 | D2 | 0 | 1 | N8 |
| A33 | 0 | D3 | 1 | 0 | N1 |
| A34 | 0 | D3 | 1 | 0 | N2 |
| A35 | 0 | D3 | 1 | 0 | N3 |
| A36 | 0 | D3 | 1 | 0 | N4 |
| A37 | 0 | D3 | 1 | 0 | N5 |
| A38 | 0 | D3 | 1 | 0 | N6 |
| A39 | 0 | D3 | 1 | 0 | N7 |
| A40 | 0 | D3 | 1 | 0 | N8 |
| A41 | 0 | D3 | 0 | 1 | N1 |
| A42 | 0 | D3 | 0 | 1 | N2 |
| A43 | 0 | D3 | 0 | 1 | N3 |
| A44 | 0 | D3 | 0 | 1 | N4 |
| A45 | 0 | D3 | 0 | 1 | N5 |
| A46 | 0 | D3 | 0 | 1 | N6 |
| A47 | 0 | D3 | 0 | 1 | N7 |
| A48 | 0 | D3 | 0 | 1 | N8 |
| A49 | 0 | D4 | 1 | 0 | N1 |
| A50 | 0 | D4 | 1 | 0 | N2 |
| A51 | 0 | D4 | 1 | 0 | N3 |
| A52 | 0 | D4 | 1 | 0 | N4 |
| A53 | 0 | D4 | 1 | 0 | N5 |
| A54 | 0 | D4 | 1 | 0 | N6 |
| A55 | 0 | D4 | 1 | 0 | N7 |
| A56 | 0 | D4 | 1 | 0 | N8 |
| A57 | 0 | D4 | 0 | 1 | N1 |
| A58 | 0 | D4 | 0 | 1 | N2 |
| A59 | 0 | D4 | 0 | 1 | N3 |
| A60 | 0 | D4 | 0 | 1 | N4 |
| A61 | 0 | D4 | 0 | 1 | N5 |
| A62 | 0 | D4 | 0 | 1 | N6 |
| A63 | 0 | D4 | 0 | 1 | N7 |
| A64 | 0 | D4 | 0 | 1 | N8 |

FIG. 9

| 4-BIT LATCH OUTPUT | | | | 2-TO-4 DECODER OUTPUT | | | | | | | |
|---|---|---|---|---|---|---|---|---|---|---|---|
| B4L | B3L | B2L | B1L | N8 | N7 | N6 | N5 | N4 | N3 | N2 | N1 |
| * | * | 0 | 0 | * | * | * | * | L | L | L | H |
| * | * | 0 | 1 | * | * | * | * | L | L | H | L |
| * | * | 1 | 0 | * | * | * | * | L | H | L | L |
| * | * | 1 | 1 | * | * | * | * | H | L | L | L |
| 0 | 0 | * | * | L | L | L | H | * | * | * | * |
| 0 | 1 | * | * | L | L | H | L | * | * | * | * |
| 1 | 0 | * | * | L | H | L | L | * | * | * | * |
| 1 | 1 | * | * | H | L | L | L | * | * | * | * |

* : DON'T CARE

FIG. 10

| AND GATE | ENB | D* | N8 ~ 5 | N4 ~ 1 |
|---|---|---|---|---|
| A1 | 0 | D1 | N5 | N1 |
| A2 | 0 | D1 | N5 | N2 |
| A3 | 0 | D1 | N5 | N3 |
| A4 | 0 | D1 | N5 | N4 |
| A5 | 0 | D1 | N6 | N1 |
| A6 | 0 | D1 | N6 | N2 |
| A7 | 0 | D1 | N6 | N3 |
| A8 | 0 | D1 | N6 | N4 |
| A9 | 0 | D1 | N7 | N1 |
| A10 | 0 | D1 | N7 | N2 |
| A11 | 0 | D1 | N7 | N3 |
| A12 | 0 | D1 | N7 | N4 |
| A13 | 0 | D1 | N8 | N1 |
| A14 | 0 | D1 | N8 | N2 |
| A15 | 0 | D1 | N8 | N3 |
| A16 | 0 | D1 | N8 | N4 |
| A17 | 0 | D2 | N5 | N1 |
| A18 | 0 | D2 | N5 | N2 |
| A19 | 0 | D2 | N5 | N3 |
| A20 | 0 | D2 | N5 | N4 |
| A21 | 0 | D2 | N6 | N1 |
| A22 | 0 | D2 | N6 | N2 |
| A23 | 0 | D2 | N6 | N3 |
| A24 | 0 | D2 | N6 | N4 |
| A25 | 0 | D2 | N7 | N1 |
| A26 | 0 | D2 | N7 | N2 |
| A27 | 0 | D2 | N7 | N3 |
| A28 | 0 | D2 | N7 | N4 |
| A29 | 0 | D2 | N8 | N1 |
| A30 | 0 | D2 | N8 | N2 |
| A31 | 0 | D2 | N8 | N3 |
| A32 | 0 | D2 | N8 | N4 |
| A33 | 0 | D3 | N5 | N1 |
| A34 | 0 | D3 | N5 | N2 |
| A35 | 0 | D3 | N5 | N3 |
| A36 | 0 | D3 | N5 | N4 |
| A37 | 0 | D3 | N6 | N1 |
| A38 | 0 | D3 | N6 | N2 |
| A39 | 0 | D3 | N6 | N3 |
| A40 | 0 | D3 | N6 | N4 |
| A41 | 0 | D3 | N7 | N1 |
| A42 | 0 | D3 | N7 | N2 |
| A43 | 0 | D3 | N7 | N3 |
| A44 | 0 | D3 | N7 | N4 |
| A45 | 0 | D3 | N8 | N1 |
| A46 | 0 | D3 | N8 | N2 |
| A47 | 0 | D3 | N8 | N3 |
| A48 | 0 | D3 | N8 | N4 |
| A49 | 0 | D4 | N5 | N1 |
| A50 | 0 | D4 | N5 | N2 |
| A51 | 0 | D4 | N5 | N3 |
| A52 | 0 | D4 | N5 | N4 |
| A53 | 0 | D4 | N6 | N1 |
| A54 | 0 | D4 | N6 | N2 |
| A55 | 0 | D4 | N6 | N3 |
| A56 | 0 | D4 | N6 | N4 |
| A57 | 0 | D4 | N7 | N1 |
| A58 | 0 | D4 | N7 | N2 |
| A59 | 0 | D4 | N7 | N3 |
| A60 | 0 | D4 | N7 | N4 |
| A61 | 0 | D4 | N8 | N1 |
| A62 | 0 | D4 | N8 | N2 |
| A63 | 0 | D4 | N8 | N3 |
| A64 | 0 | D4 | N8 | N4 |

PRINTHEAD AND PRINTING APPARATUS USING SAID PRINTHEAD

FIELD OF THE INVENTION

The present invention relates to a printhead and a printing apparatus using said printhead, and more particularly, to a printhead structured such that a plurality of printing elements arranged in a predetermined direction and a driving circuit for driving the printing elements are provided on one substrate, and that the printing elements are divisionally driven in unit of plural blocks, and to a printing apparatus using said printhead.

BACKGROUND OF THE INVENTION

A printing apparatus, such as a printer which prints data, such as desired characters or images, on a sheet-type printing medium, such as paper or film, is widely used as a data output apparatus in a word processor, personal computer, facsimile apparatus or the like.

Various printing methods of a printer are known. Particularly, an inkjet printing method recently receives attention because of the following reasons: capability to perform printing without contacting a printing medium such as paper, ease of color printing, and quiet printing operation. With respect to a structure of the inkjet printing method, serial printing method is widely adopted in general because it is low cost and easy to downsize. Serial printing realizes printing by reciprocally scanning a printhead, which discharges ink in accordance with desired printing data, in the direction intersecting with the printing medium conveyance direction.

As an ink discharging method of the inkjet printing method, method utilizing heat energy is known. In this case, the printhead comprises electrothermal transducers, such as heating elements, in the portions connected to discharge orifices which discharge ink droplets. The heating elements are electrified for a few $\mu$ seconds to generate bubbles in the ink, and pressure of the bubbles causes to discharge ink droplets, thereby realizing printing.

In a printhead of this type, it is easy to arrange a large number of discharge orifices and heating elements at high density. Therefore, high-precision image printing can be realized.

Assuming if all the heating elements of the printhead are simultaneously driven, the instantaneous current value becomes high. As a result, a large capacity of power source is required. In view of this, normally time-divisional driving is performed to keep a low instantaneous current value. In the time-divisional driving, few tens or few hundreds of heating elements are divided into a plurality of blocks, and the blocks are driven at slightly different timings.

Furthermore, to drive a large number of heating elements, a driving circuit of the heating elements is incorporated in the substrate of the printhead, keeping the number of wirings between the printhead and printer's main unit low. A silicon (Si) wafer is widely used as a material (element substrate) of the printhead substrate, which incorporates the heating elements and driving circuit.

Among various structures of a circuit manufactured in the substrate, typical structure is described below.

A printing apparatus main unit serially inputs printing data and encoded block data through one signal line. A printhead, receiving the inputted data, comprises a shift register for sequentially storing the signal one bit at a time; a latch for temporarily storing the data stored in the shift register; a decoder for decoding the block data stored in the latch; an AND gate for obtaining AND of the latched printing data, decoded block data, and signal specifying the driving timing; and a driving transistor for driving each heating element in accordance with an output of the AND gate.

Herein, a value obtained by dividing the number of all heating elements by the number of blocks is the number of heating elements, which can be driven simultaneously, thus is a number of bits of printing data. Either a bipolar transistor or a FET may be used as the driving transistor.

However, the conventional printhead having an above-described circuit structure has the following problems.

The number of AND gates and driving transistors provided in the printhead corresponds to the number of heating elements. Therefore, in order to input decoded block data to each of the AND gates, the number of signal lines as many as the number of blocks is necessary between the decoder and AND gates. When there are a large number of heating elements, the wiring area of the signal lines is enlarged, making it difficult to downsize a semiconductor chip.

As a result, this wiring area limits the number of semiconductor chips, manufactured from one sheet of semiconductor wafer in the manufacturing process of a semiconductor chip that is used as a printhead substrate. For this reason, lowering the manufacturing cost of a printhead substrate becomes difficult. As a result, cost reduction of a printhead using the substrate becomes difficult.

SUMMARY OF THE INVENTION

The present invention has been proposed to solve the conventional problems, and has as its object to provide a printhead which can realize cost reduction of a printhead by reducing the area of a printhead substrate.

Another object of the present invention is to provide a printing apparatus using a printhead which can realize cost reduction of a printhead by reducing the area of a printhead substrate.

According to the present invention, above object is attained by a printhead structured such that a plurality of printing elements arranged in a predetermined direction and a driving circuit driving the printing elements are provided on one substrate, and that the printing elements are divisionally driven in unit of plural blocks, comprising: an input terminal serially inputting printing data corresponding to each printing element and encoded block data designating a block to be driven; a shift register sequentially shifting and storing one bit at a time the data serially inputted from the input terminal; a latch temporarily storing the data stored in the shift register; a decoder decoding the encoded block data among the data stored in the latch; and an AND circuit performing AND operation of the printing data outputted from the latch, an output of the decoder, and a driving signal designating driving timing of the driving circuit, wherein the decoder outputs a signal in which the encoded block data is partially decoded, and the AND circuit determines a block to be driven based on the partially decoded signal.

According to the present invention, above another object is attained by a printing apparatus utilizing a printhead structured such that a plurality of printing elements arranged in a predetermined direction and a driving circuit driving the printing elements are provided on one substrate, and that the printing elements are divisionally driven in unit of plural blocks, the printhead comprising: an input terminal serially inputting printing data corresponding to each printing element and encoded block data designating a block to be driven; a shift register sequentially shifting and storing one bit at a time the data serially inputted from the input terminal; a latch temporarily storing the data stored in the shift register; a decoder decoding the encoded block data among the data stored in the latch; and an AND circuit performing AND operation of the printing data outputted from the latch, an output of the decoder, and a driving signal designating driving timing of the driving circuit, wherein the decoder outputs a signal in which the encoded block data is partially decoded, and the AND circuit determines a block to be driven based on the partially decoded signal.

In other words, according to the printhead proposed by the present invention, a plurality of printing elements arranged in a predetermined direction and a driving circuit driving the printing elements are provided on one substrate. The printing elements are structured so as to be divisionally driven in unit of plural blocks. The printhead includes: an input terminal, to which printing data corresponding to each printing element and encoded block data designating a block to be driven are inputted; a shift register which sequentially shifts and stores one bit at a time the data serially inputted from the input terminal; a latch which temporarily stores the data stored in the shift register; a decoder which decodes the encoded block data among the data stored in the latch; and an AND circuit which performs AND operation of the printing data outputted from the latch, an output from the decoder, and a driving signal designating driving timing of the driving circuit. The printhead is constructed such that the decoder outputs a signal where the encoded block data is partially decoded, and that the AND circuit determines a block to be driven based on the partially decoded signal.

By virtue of the above construction, the number of signal lines outputted from the decoder is reduced, thereby enabling to reduce the area necessary for wiring the signal lines.

Accordingly, an yield of semiconductor chips manufactured from a piece of semiconductor wafer increases. Thus, it is possible to realize cost reduction of a printhead.

Furthermore, since the area necessary for wiring the signal lines is reduced, the wiring length of the circuit can be reduced. Therefore, radiant noise can be suppressed.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

FIG. 4 is a truth table of a decoder 106 shown in FIG. 3;

FIG. 5 is a table showing input signals that activate AND circuits A1 to A64 shown in FIG. 3;

FIG. 9 is a truth table of decoders 806 and 807 shown in FIG. 8;

FIG. 10 is a table showing input signals that activate AND circuits A1 to A64 shown in FIG. 8.

DETAILED DESCRIPTION OF THE PREFERRED EMBODIMENTS

Preferred embodiments of the present invention will now be described in detail in accordance with the accompanying drawings.

In the embodiments to be explained below, a printing apparatus using an inkjet printing system will be described by taking a printer as an example.

In this specification, "print" is not only to form significant information such as characters and graphics, but also to form, e.g., images, figures, and patterns on printing media in a broad sense, regardless of whether the information formed is significant or insignificant or whether the information formed is visualized so that a human can visually perceive it, or to process printing media.

"Print media" are any media capable of receiving ink, such as cloth, plastic films, metal plates, glass, ceramics, wood, and leather, as well as paper sheets used in common printing apparatuses.

Furthermore, "ink" (to be also referred to as a "liquid" hereinafter) should be broadly interpreted like the definition of "print" described above. That is, ink is a liquid which is applied onto a printing medium and thereby can be used to form images, figures, and patterns, to process the printing medium, or to process ink (e.g., to solidify or insolubilize a colorant in ink applied to a printing medium).

An "substrate" (to be also referred to as an "element board" hereinafter) includes not only a base plate made of a silicon semiconductor but also a base plate bearing elements and wiring lines.

The following expression "on an substrate" means "the surface of an substrate" or "the inside of an substrate near its surface" in addition to "on an substrate". "Built-in" in the present invention does not represent a simple layout of separate elements on a base, but represents integral formation/manufacture of elements on an substrate by a semiconductor circuit manufacturing process.

Brief Description of a Printing Apparatus

Figure 1:
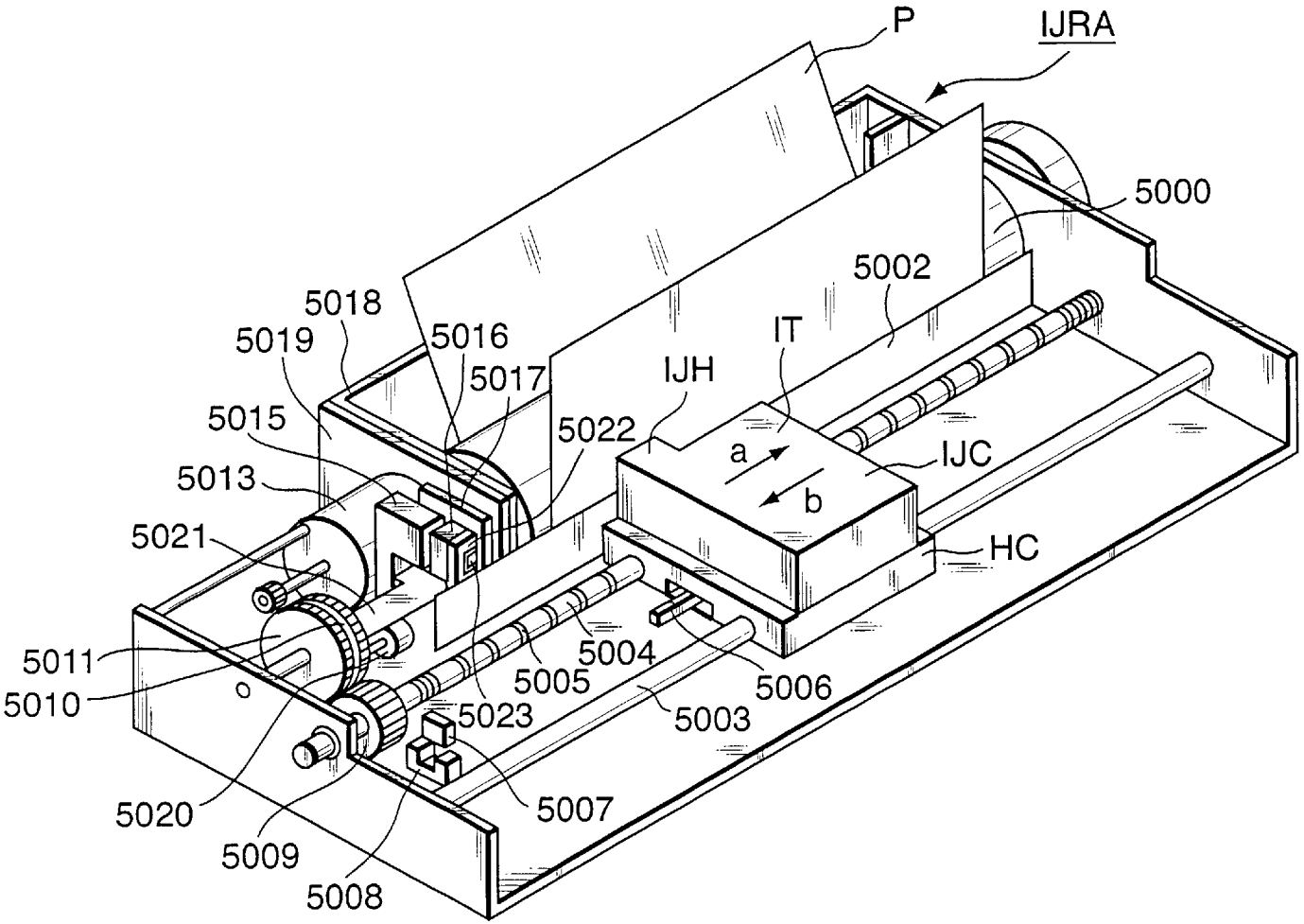
FIG. 1 is a perspective view showing an outer appearance of a construction of a printing apparatus according to the present invention.

FIG. 1 is a perspective view showing the outer appearance of an ink-jet printer IJRA as a typical embodiment of the present invention. Referring to FIG. 1, a carriage HC engages with a spiral groove 5004 of a lead screw 5005, which rotates via driving force transmission gears 5009 to 5011 upon forward/reverse rotation of a drive motor 5013. The carriage HC has a pin (not shown), and is reciprocally moved in directions of arrows a and b in FIG. 1. An integrated ink-jet cartridge IJC which incorporates a printing head IJH and an ink tank IT is mounted on the carriage HC. Reference numeral 5002 denotes a sheet pressing plate, which presses a paper sheet against a platen 5000, ranging from one end to the other end of the scanning path of the carriage.

Reference numerals 5007 and 5008 denote photocouplers which serve as a home position detector for recognizing the presence of a lever 5006 of the carriage in a corresponding region, and used for switching, e.g., the rotating direction of motor 5013. Reference numeral 5016 denotes a member for supporting a cap member 5022, which caps the front surface of the printing head IJH; and 5015, a suction device for sucking ink residue through the interior of the cap member. The suction device 5015 performs suction recovery of the printing head via an opening 5023 of the cap member 5015. Reference numeral 5017 denotes a cleaning blade; 5019, a member which allows the blade to be movable in the back-and-forth direction of the blade. These members are supported on a main unit support plate 5018.

The shape of the blade is not limited to this, but a known cleaning blade can be used in this embodiment. Reference numeral 5021 denotes a lever for initiating a suction operation in the suction recovery operation. The lever 5021 moves upon movement of a cam 5020, which engages with the carriage, and receives a driving force from the driving motor via a known transmission mechanism such as clutch switching.

The capping, cleaning, and suction recovery operations are performed at their corresponding positions upon operation of the lead screw 5005 when the carriage reaches the home-position side region. However, the present invention is not limited to this arrangement as long as desired operations are performed at known timings.

Note that the ink tank IT and the printing head IJH are integrally formed to construct an exchangeable ink cartridge IJC, however, the ink tank IT and the printing head IJH may be separately formed such that when ink is exhausted, only the ink tank IT can be exchanged for new ink tank.

Description of a Control Arrangement

Next, the control structure for performing the printing control of the above apparatus is described.

Figure 2:
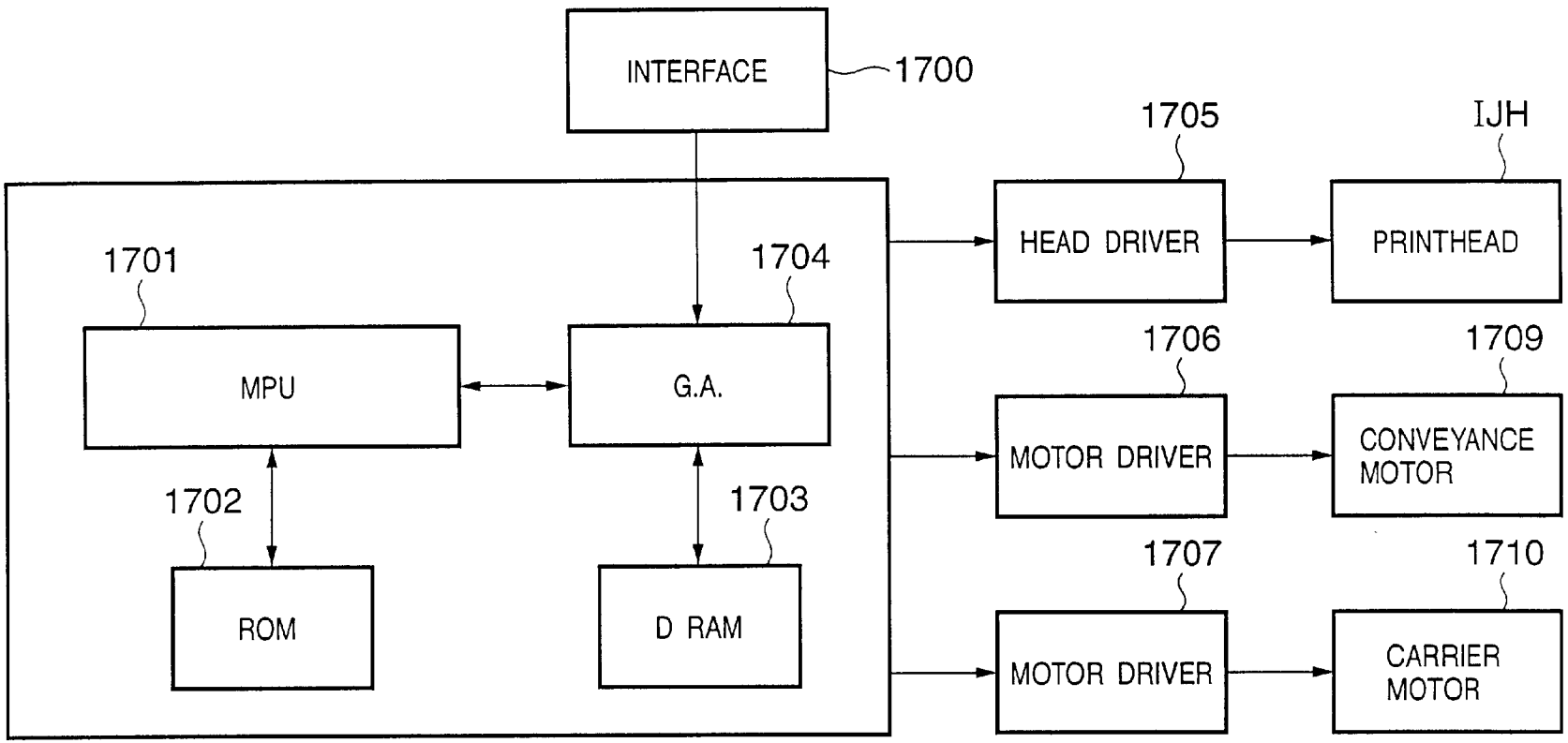
FIG. 2 is a block diagram showing an arrangement of a control circuit of the printing apparatus shown in FIG. 1.

FIG. 2 is a block diagram showing the arrangement of a control circuit of the ink-jet printer. Referring to FIG. 2 showing the control circuit, reference numeral 1700 denotes an interface for inputting a print signal from an external unit such as a host computer; 1701, an MPU; 1702, a ROM for storing a control program (including character fonts if necessary) executed by the MPU 1701; and 1703, a DRAM for storing various data (the print signal, print data supplied to the printing head and the like). Reference numeral 1704 denotes a gate array (G. A.) for performing supply control of print data to the printing head IJH. The gate array 1704 also performs data transfer control among the interface 1700, the MPU 1701, and the RAM 1703. Reference numeral 1710 denotes a carrier motor for transferring the printing head IJH in the main scanning direction; and 1709, a transfer motor for transferring a paper sheet. Reference numeral 1705 denotes a head driver for driving the printing head; and 1706 and 1707, motor drivers for driving the transfer motor 1709 and the carrier motor 1710.

The operation of the above control arrangement will be described below. When a print signal is inputted into the interface 1700, the print signal is converted into print data for a printing operation between the gate array 1704 and the MPU 1701. The motor drivers 1706 and 1707 are driven, and the printing head is driven in accordance with the print data supplied to the head driver 1705, thus performing the printing operation.

Though the control program executed by the MPU 1701 is stored in the ROM 1702, an arrangement can be adopted in which a writable storage medium such as an EEPROM is additionally provided so that the control program can be altered from a host computer connected to the ink-jet printer IJRA.

First Embodiment of Printhead IJH

Hereinafter, a first embodiment of a printhead IJH, employed by a printer IJRA having the above-described configuration, is described. Note that the printhead IJH described hereinafter, employing heating elements as printing elements, comprises two sets of 64 heating elements, i.e., the total of 128 heating elements. One set of 64 heating elements are divided into 4 blocks, each block including 16 heating elements (the number of division N=16). One heating element of each of the 4 blocks (i.e., 4 heating elements) is driven simultaneously (the number of heating elements simultaneously driven M=4).

Figure 3:
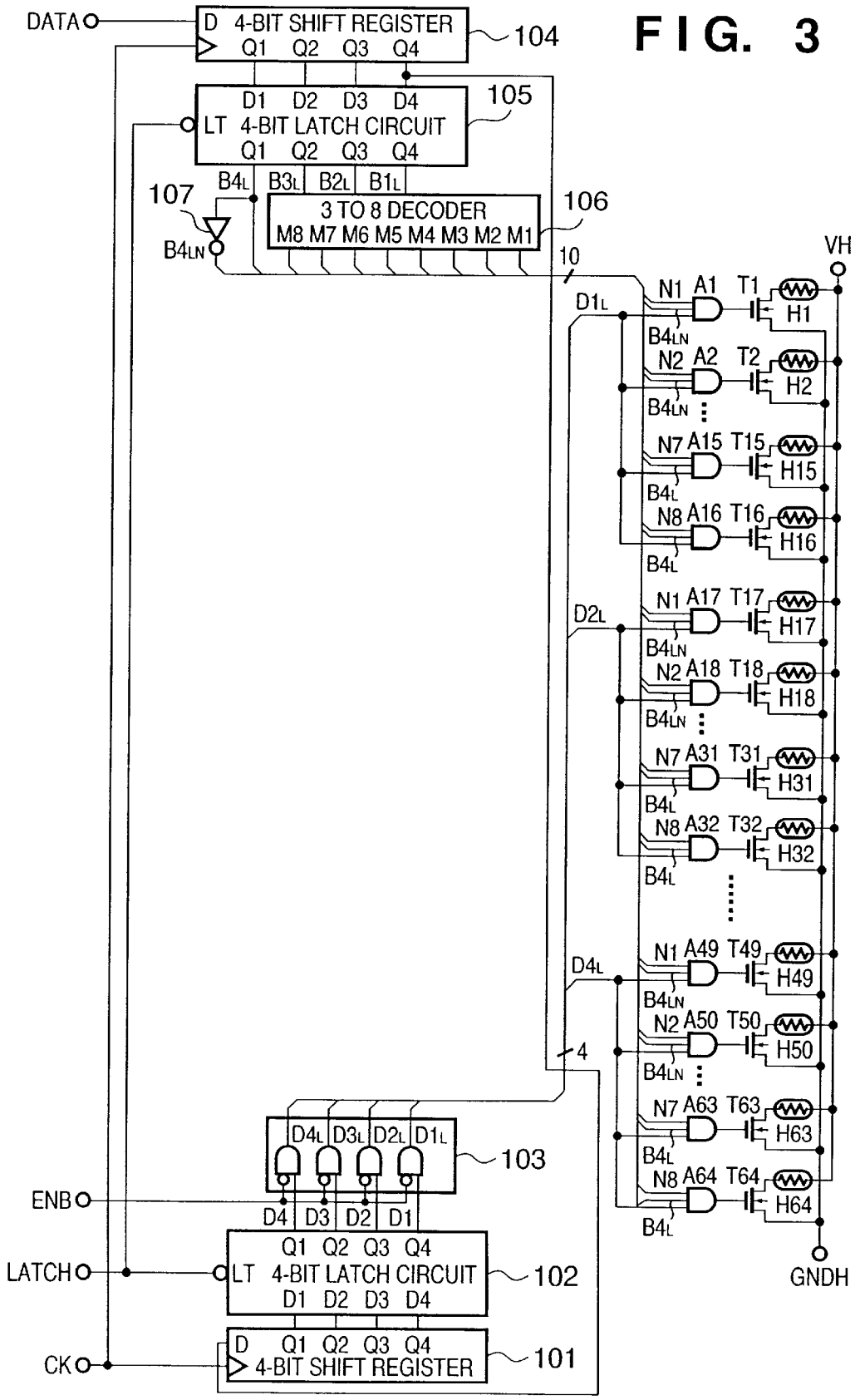
FIG. 3 is a circuit diagram showing a circuit structure of a printhead substrate according to a first embodiment of a printhead IJH.

FIG. 3 is a circuit diagram showing a circuit structure made on a printhead substrate with respect to a set of heating elements of the printhead IJH according to the first embodiment. In the circuit shown in FIG. 3, the power voltage line (VH) as well as ground voltage line (GNDH) which supply the heating elements with a driving voltage, and four signal lines: printing data DATA, clock CK, enable signal ENB, and latch signal LATCH are supplied from the main unit of the printer IJRA. This circuit is structured such that pixel signals D1L to D4L and block control signals B1L to B4L are generated by the shift registers and latch circuits based on the aforementioned four signal lines to control driving of each heating element.

In FIG. 3, reference numeral 104 denotes a 4-bit shift register, to which printing data DATA is serially inputted in accordance with clock signal CK; 101, a 4-bit shift register, to which printing data DATA outputted from the shift register 104 in accordance with the clock signal CK is serially inputted; 102, a 4-bit latch circuit which latches 4 bits of block control data stored in the 4-bit shift register 101 in accordance with latch signal LATCH; and 105, a 4-bit latch circuit which latches 4 bits of pixel data stored in the 4-bit shift register 104 in accordance with latch signal LATCH.

Reference numeral 103 denotes an AND circuit which performs AND operation of the enable signal ENB and output signals D1 to D4 of the 4-bit latch circuit 102 to output pixel signals D1L to D4L. Numeral 106 denotes a 4-to-8 decoder which inputs and decodes block control signals B1L to B3L supplied from the 4-bit latch circuit 105 to generate block selection signals N1 to N8. Numeral 107 denotes an inverter which reverses block control signal B4L supplied from the 4-bit latch circuit 105 to output block control signal B4LN.

H1 to H64 denote heating elements. T1 to T64 denote power transistors which control electrification to the heating elements H1 to H64. A1 to A64 denote 3-input AND gates provided in correspondence with the power transistors T1 to T64. The pixel signals D1L to D4L outputted by the AND circuit 103, any of the block selection signals N1 to N8 outputted by the 4-to-8 decoder 106, and block control signal B4L outputted by the 4-bit latch circuit 105 or block control signal B4LN outputted by the inverter 107 are inputted to the AND gates A1 to A64 which then perform AND operation of the three signals.

The block control signal B4LN outputted by the inverter 107 is inputted to the AND gates corresponding to the first to eighth heating elements of each block, while the block control signal B4L outputted by the 4-bit latch circuit 105 is inputted to the AND gates corresponding to the ninth to sixteenth heating elements.

Then, output signals from the AND gates A1 to A64 are inputted to the corresponding power transistors T1 to T64 to control electrification of the connected heating elements H1 to H64. In other words, driving timing and pulsewidth for driving the heating elements are determined by the pixel signals D1L to D4L outputted by the AND circuit 103, block selection signals N1 to N8 outputted by the 4-to-8 decoder 106, and block control signal B4L outputted by the 4-bit latch circuit 105 or block control signal B4LN outputted by the inverter 107. Note that the enable signal ENB operates with a negative logic. In other words, a heating element is driven when an enable signal ENB is low.

FIG. 4 is a truth table of the 3-to-8 decoder 106. As shown in the table, each combination of signals B1L to B4L outputted by the 4-bit latch circuit 105 determines the active-state ("High") block selection signals N1 to N8.

FIG. 5 is a table showing AND gates A1 to A64 which become in active state ("High") in accordance with the combination of output signal B4LN of the inverter 107, output signal B4L of the 4-bit latch circuit 105, output signals N1 to N8 of the 3-to-8 decoder 106, output signals D1 to D4 of the 4-bit latch circuit 102, and ENB signals.

This table shows that the AND gate is activated when it receives the signals specified in each row of the table. In this table, "0" indicates "Low" and "1" indicates "High". For instance, AND gate A1 is activated when the ENB signal is "Low", D1 and B4LN are "High", B4L is "Low", and N1 is "High". Note that each of the signals D1 to D4 may be in active state simultaneously. AND circuits that can be simultaneously activated are, for instance, A1, A17, A33, and A49, four at the maximum.

As described above, according to the first embodiment, output signals from the decoder, which conventionally had 16 signals, are reduced to 10 signals: 8 output signals from the decoder, undecoded block control signal and its reversed signal, for controlling the driving of the 16 heating elements in each block.

Figure 6:
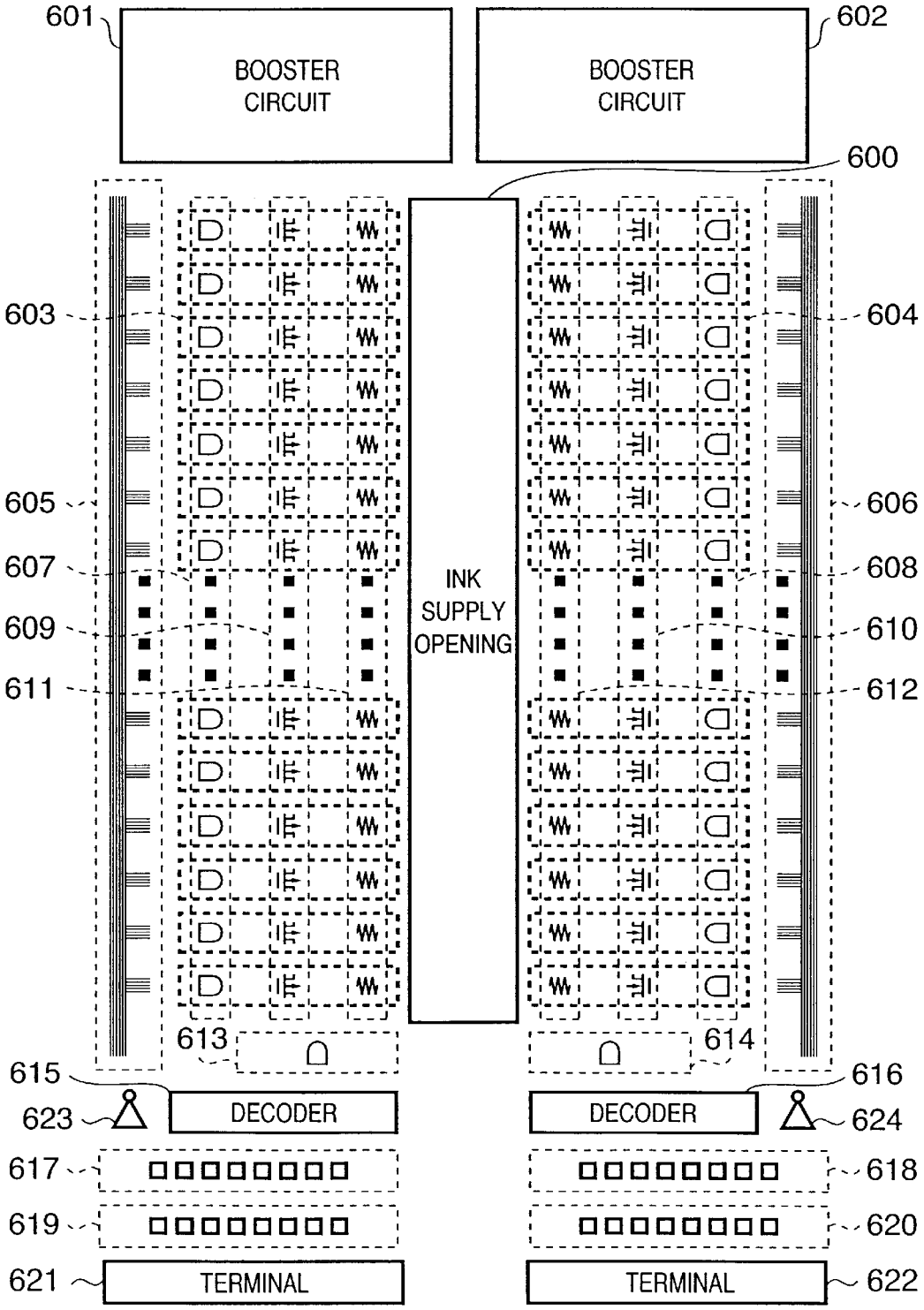
FIG. 6 is a layout view showing an arrangement on the printhead substrate shown in the circuit of FIG. 3.

FIG. 6 shows a layout of a circuit in a case where a printhead substrate is manufactured on a semiconductor chip. In the structure shown in FIG. 6, two of the circuit shown in FIG. 3 are provided symmetrically with respect to an ink supply opening 600. As similar to a conventional substrate, silicon (Si) wafer or the like is used as a material (element substrate) of the printhead substrate.

Reference numerals 621 and 622 denote input terminal areas for connecting signal lines (printing data DATA, latch signal LATCH, clock signal CK, enable signal ENB, power voltage VH, and ground voltage GNDH) supplied from the printer IJRA main unit to the printhead. Numerals 619 and 620 denote areas for 8-bit shift registers, consisting of two 4-bit shift registers 101 and 104. Numerals 617 and 618 denote areas for 8-bit latch circuits, consisting of two 4-bit latch circuits 102 and 105. Numerals 623 and 624 denote areas for inverter 107.

Reference numerals 613 and 614 denote areas for AND circuit 103; 615 and 616, areas for decoder 106; 623 and 624, areas for inverter 107; 607 and 608, areas for AND gates A1 to A64; 609 and 610, areas for power transistors T1 to T64; 611 and 612, areas for heating elements H1 to H64; and 605 and 606, wiring areas for 14 signal lines consisting of D1L to D4L, N1 to N8, B4L and B4LN.

Reference numerals 601 and 602 denote areas for a booster circuit which increases a gate voltage of the power transistors to a level higher than a driving voltage of the logic circuit in order to improve the driving capacity of the power transistors 609 and 610. Numeral 600 denotes an area for an ink supply opening which supplies ink from the back surface to the heating elements H1 to H64. Numerals 603 and 604 denote areas for driving circuits including one heating element, a power transistor and an AND gate provided in correspondence with the heating element.

Comparing the layout of the printhead substrate according to this embodiment with a layout of a conventional printhead substrate used in general, the size of the wiring areas 605 and 606 as well as decoder areas 615 and 616 are reduced, because of the reduced number of signal lines outputted from the decoders as described above. Although the inverter areas 623 and 624 are newly provided and the AND gate areas 607 and 608 are slightly enlarged, by virtue of the reduced size of the wiring areas, the circuit size as a whole is much smaller than the conventional size.

Figure 7:
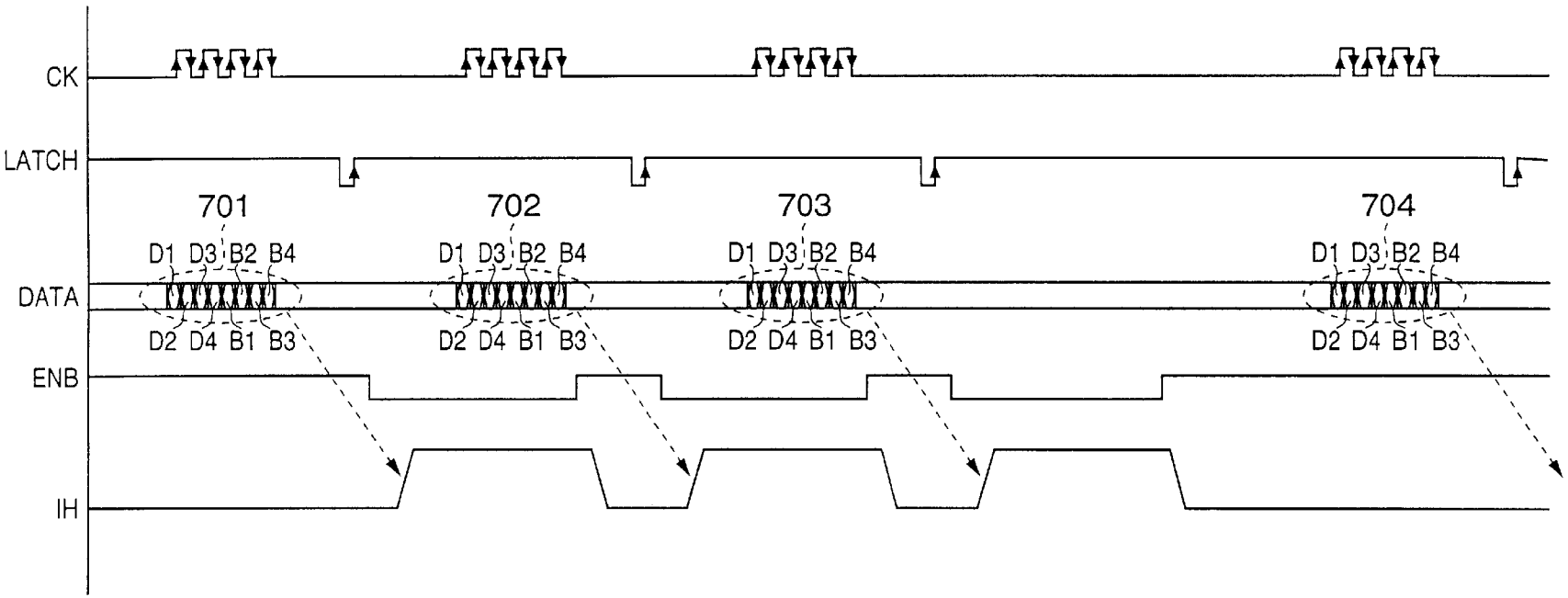
FIG. 7 is a timing chart showing a driving timing of the printhead IJH having the structure shown in FIG. 3.

FIG. 7 is a timing chart showing a state of each signal applied to drive the printhead IJH having the structure shown in FIG. 3. The printing data DATA is inputted in synchronization with a rise and drop of the clock signal CK. At the timing the latch signal LATCH is "Low", data stored in the shift registers 101 and 104 are stored respectively in the latches 102 and 105. While the enable signal ENB is "Low", the heating elements are driven to supply a driving current IH, and as a result, ink droplets are discharged.

Reference numerals 701 to 704 denote strings of printing data DATA. The driving current IH, caused by driving the heating elements corresponding to each data, is supplied during the period of "Low" ENB signal after the data contents are confirmed by LATCH, as indicated by the arrow in FIG. 7.

As can be seen from the timing chart, this embodiment is constructed to operate even if the data transfer timing 701 to 704 overlap with the driving timing of previously transferred data. By allowing overlaps of transfer timing and driving timing, printing speed of the printer IJRA can be improved.

Modification to the First Embodiment

In the above-described first embodiment, printing data DATA is captured by the 4-bit shift registers 101 and 104 at both leading and trailing edges of the clock signal CK. However, the printing data may be captured in synchronization with either leading or trailing edge of CK. Further, the shift register may be constructed with a latch circuit employing a through latch instead of a flip-flop circuit which operates in synchronization with clock edges.

Similarly, the 4-bit latch circuits 102 and 105 may be constructed with a flip-flop circuit in place of the latch circuit. The logic of the latch circuit may be a high-through. If a flip-flop structure is adopted, the condition for capturing signals may be a leading edge or trailing edge.

In the construction of the first embodiment, output signals N1 to N8 of the 3-to-8 decoder 106, and block control signal B4L or output signal B4LN of the inverter 107 are inputted to the AND gates A1 to A64. However, block control signals inputted to the 3-to-8 decoder 106 may be any of B1L to B4L. It should be noted that, as described above, unselected signals are inputted to the inverter 107, then inputted to each AND gate together with the inverted signals of the unselected signals.

Instead of providing the aforementioned AND circuit 103, AND may be calculated from the output signals N1 to N8 of the 3-to-8 decoder 106, output signal B4L of the 4-bit latch circuit, output signal B4LN of the inverter 107, and enable signal ENB, then AND may be further calculated from the obtained AND and the output signals D1 to D4 of the 4-bit latch circuit 102 by the AND gates A1 to A64. Alternatively, 4 input terminals may be provided to the AND gates A1 to A64, and AND may be obtained from the output signals N1 to N8 of the 3-to-8 decoder 106, block control signal B4L or output signal B4LN of the inverter 107, enable signal ENB, and output signal of the 4-bit latch circuit 102.

Furthermore, allocation of the printing signal and block control signal in the printing data DATA is not particularly limited, but any configuration may be adopted.

Second Embodiment of Printhead IJH

Hereinafter, the second embodiment of the printhead IJH according to the present invention is described. With respect to the components similar to that of the first embodiment, descriptions will be omitted, but only the characteristic part of the second embodiment will be described.

As similar to the first embodiment, the printhead IJH according to the second embodiment employs a heating element as a printing element, and comprises two sets of 64 heating elements, i.e., the total of 128 heating elements. One set of 64 heating elements are divided into 4 blocks, each block including 16 heating elements. One heating element of each of the 4 blocks is driven simultaneously.

Figure 8:
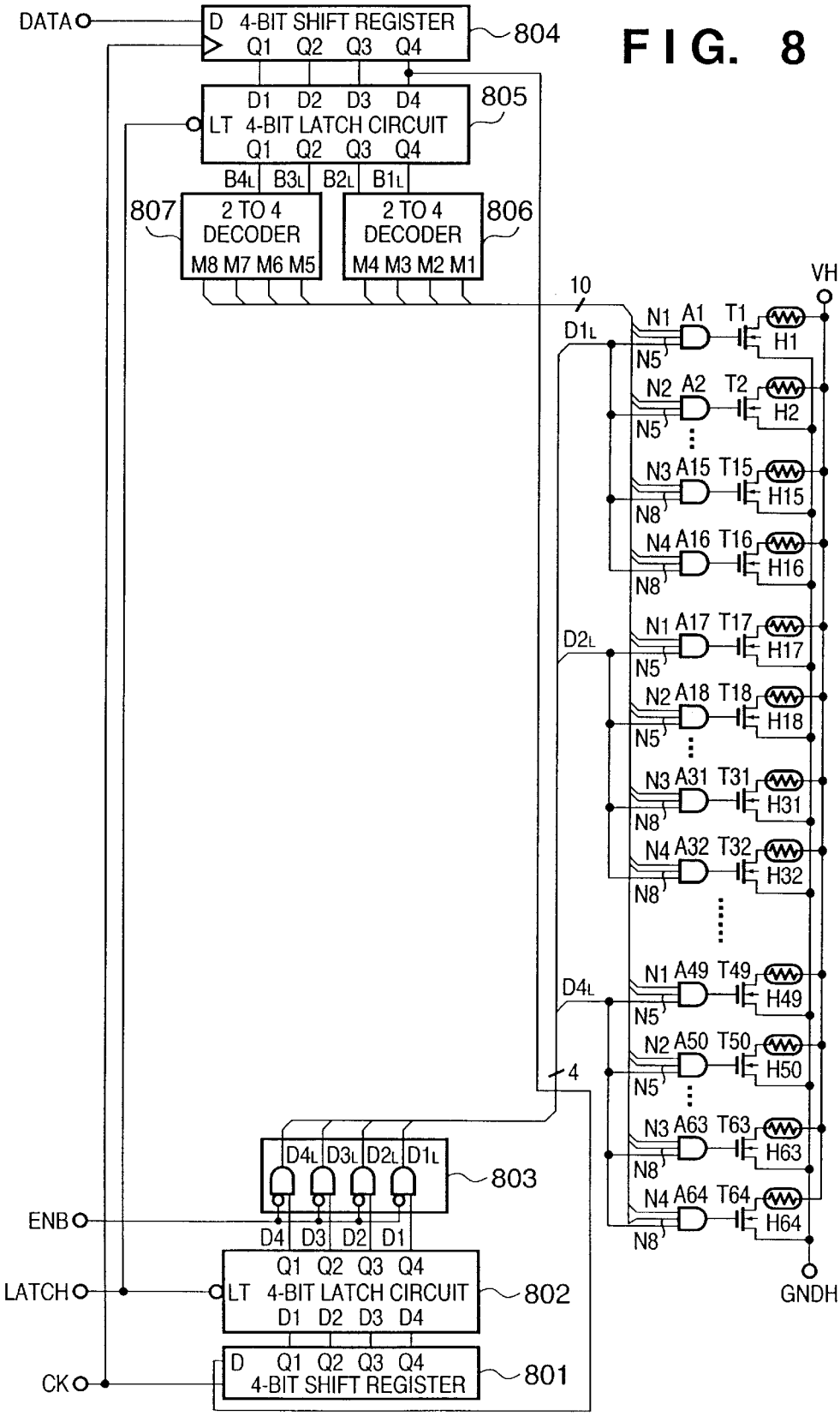
FIG. 8 is a circuit diagram showing a circuit structure of a printhead substrate according to a second embodiment of the printhead IJH.

FIG. 8 is a circuit diagram showing, as similar to FIG. 3, a circuit structure made on a printhead substrate with respect to a set of heating elements of the printhead IJH according to the second embodiment. In the circuit shown in FIG. 8, the power voltage line (VH) as well as ground voltage line (GNDH) which supply the heating elements with a driving voltage, and four signal lines: printing data DATA, clock CK, enable signal ENB, and latch signal LATCH are supplied from the main unit of the printer IJRA. This circuit is structured such that pixel signals D1L to D4L and block control signals B1L to B4L are generated by the shift registers and latch circuits based on the aforementioned four signal lines to control driving of each heating element.

In FIG. 8, reference numeral 804 denotes a 4-bit shift register, to which printing data DATA is serially inputted in accordance with clock signal CK; 801, a 4-bit shift register, to which printing data DATA outputted from the shift register 804 in accordance with the clock signal CK is serially inputted; 802, a 4-bit latch circuit which latches 4 bits of block control data stored in the 4-bit shift register 801 in accordance with latch signal LATCH; and 805, a 4-bit latch circuit which latches 4 bits of pixel data stored in the 4-bit shift register 804 in accordance with latch signal LATCH.

Reference numeral 803 denotes an AND circuit which performs AND operation of the enable signal ENB and output signals D1 to D4 of the 4-bit latch circuit 802 to output pixel signals D1L to D4L. Numeral 806 denotes a 2-to-4 decoder which inputs and decodes block control signals B1L to B2L supplied from the 4-bit latch circuit 805 to generate block selection signals N1 to N4. Numeral 807 denotes a 2-to-4 decoder which inputs and decodes block control signals B3L to B4L supplied from the 4-bit latch circuit 805 to generate block selection signals N5 to N8.

H1 to H64 denote heating elements. T1 to T64 denote power transistors which control electrification to the heating elements H1 to H64. A1 to A64 denote 3-input AND gates provided in correspondence with the power transistors T1 to T64. The pixel signals D1L to D4L outputted by the AND circuit 803, any of the block selection signals N1 to N4 outputted by the 2-to-4 decoder 806, and any of the block selection signals N5 to N8 outputted by the 2-to-4 decoder 807 are inputted to the AND gates A1 to A64, which then perform AND operation of the three signals. The block selection signals inputted to each AND gate will be described later.

Then, output signals from the AND gates A1 to A64 are inputted to the corresponding power transistors T1 to T64 to control electrification of the connected heating elements H1 to H64. In other words, timing and pulsewidth for driving the heating elements are determined by the pixel signals D1L to D4L outputted by the AND circuit 803, block selection signals N1 to N4 outputted by the 2-to-4 decoder 806, and block selection signals N5 to N8 outputted by the 2-to-4 decoder 807. Note that the enable signal ENB operates with a negative logic. In other words, a heating element is driven when an enable signal ENB is low.

As described above, in the circuit of the printhead according to the second embodiment, the block control signals B1L to B4L supplied from the 4-bit latch circuit 805 are decoded into N1 to N4 and N5 to N8 respectively by the two 2-to-4 decoders 806 and 807, and the eight signals N1 to N8 are used as block control signals.

FIG. 9 is a truth table of the 2-to-4 decoders 806 and 807. As shown in the table, each combination of signals B1L to B4L outputted by the 4-bit latch circuit 805 determines the active-state ("High") block selection signals N1 to N8.

FIG. 10 is a table showing AND gates A1 to A64 which become in active state ("High") in accordance with the combination of output signals N1 to N4 of the 2-to-4 decoder 806, output signals N5 to N8 of the 2-to-4 decoder 807, output signal of 4-bit latch circuit 802, and ENB signal.

This table shows that the AND gate is activated when it receives the signals specified in each row of the table. In this table, "0" indicates "Low". For instance, AND gate A1 is activated when the ENB signal is "Low", D1, N5 and N1 are "High". Note that each of the signals D1 to D4 may be in active state simultaneously. AND circuits that can be simultaneously activated are, for instance, A1, A17, A33, and A49, four at the maximum.

As described above, according to the second embodiment, output signals from the decoder, which conventionally had 16 signals, are reduced to 8 signals outputted by the two 2-to-4 decoders, and used for controlling the driving of the 16 heating elements in each block.

Figure 11:
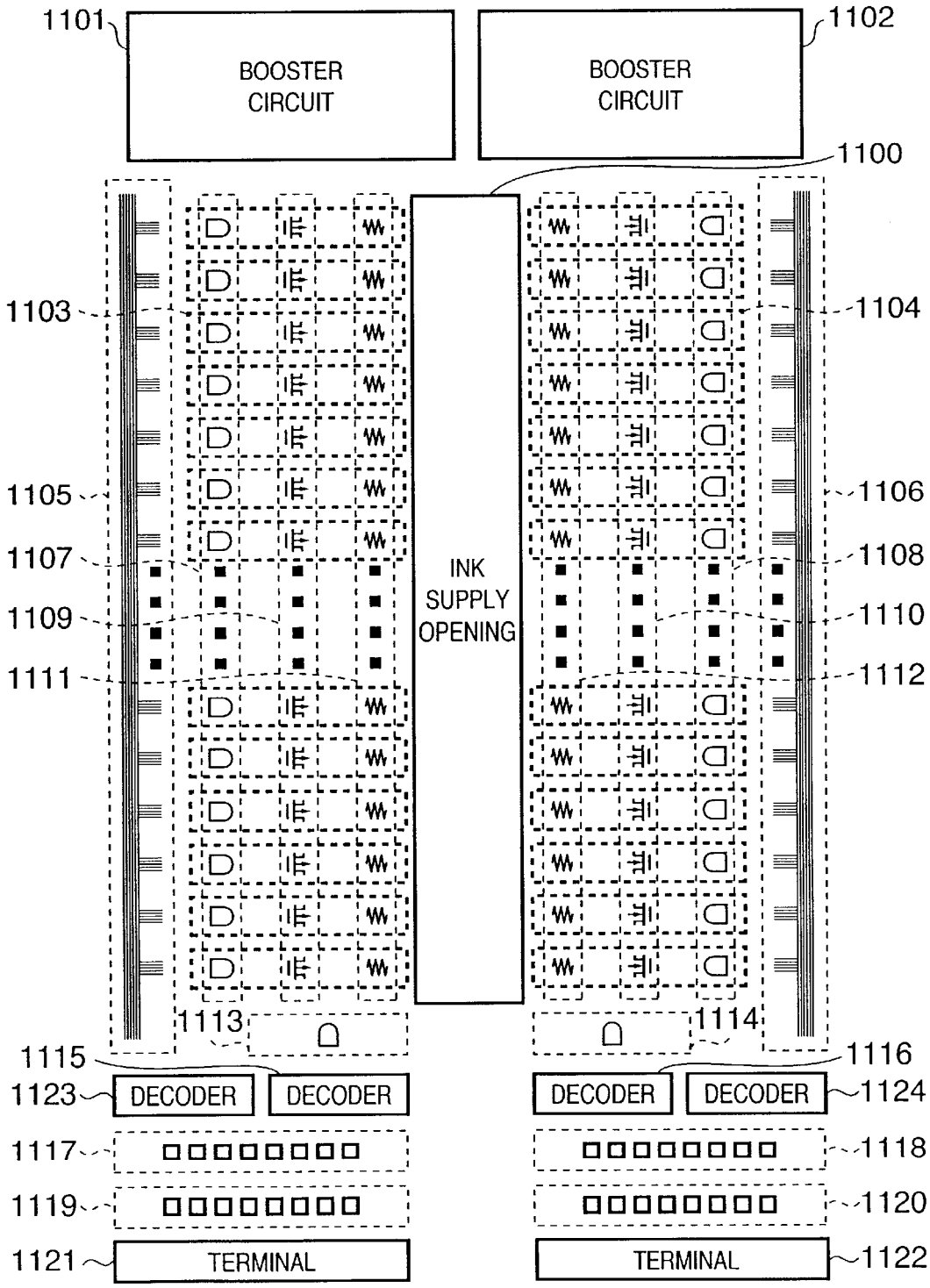
FIG. 11 is a layout view showing an arrangement on the printhead substrate shown in the circuit of FIG. 8.

FIG. 11 shows a layout of a circuit in a case where a printhead substrate is manufactured on a semiconductor chip. In the structure shown in FIG. 11, two of the circuit shown in FIG. 8 are provided symmetrically with respect to an ink supply opening 1100. As similar to a conventional substrate, silicon (Si) wafer or the like is used as a material (element substrate) of the printhead substrate.

Reference numerals 1121 and 1122 denote input terminal areas for connecting signal lines (printing data DATA, latch signal LATCH, clock signal CK, enable signal ENB, power voltage VH, and ground voltage GNDH) supplied from the printer IJRA main unit to the printhead. Numerals 1119 and 1120 denote areas for 8-bit shift registers, consisting of two 4-bit shift registers 801 and 804. Numerals 1117 and 1118 denote areas for 8-bit latch circuits, consisting of two 4-bit latch circuits 802 and 805.

Reference numerals 1113 and 1114 denote areas for AND circuit 803; 1115 and 1116, areas for decoder 806; 1123 and 1124, areas for decoder 807; 1107 and 1108, areas for AND gates A1 to A64; 1109 and 1110, areas for power transistors T1 to T64; 1111 and 1112, areas for heating elements H1 to H64; and 1105 and 1106, wiring areas for 12 signal lines consisting of D1L to D4L and N1 to N8.

Reference numerals 1101 and 1102 denote areas for a booster circuit which increases a gate voltage of the power transistors to a level higher than a driving voltage of the logic circuit in order to improve the driving capacity of the power transistors 1111 and 1112. Numeral 1100 denotes an area for an ink supply opening which supplies ink from the back surface to the heating elements H1 to H64. Numerals 1103 and 1104 denote areas for driving circuits including one heating element, a power transistor and AND gate provided in correspondence with the heating element.

Comparing the layout of the printhead substrate according to this embodiment with a layout of a conventional printhead substrate used in general, the size of the wiring areas 1105 and 1106 are reduced, because of the reduced number of signal lines outputted from the decoders as described above. Although the AND gate areas 1107 and 1108 are slightly enlarged, by virtue of the reduced size of the wiring areas, the circuit size as a whole is much smaller than the conventional size.

With respect to the state of each signal applied to drive the printhead IJH having the structure shown in FIG. 8, description thereof is omitted since it is similar to the timing chart described in the first embodiment.

Modification to the Second Embodiment

In the above-described second embodiment, printing data DATA is captured by the two 4-bit shift registers 801 and 804 at both leading and trailing edges of the clock signal CK. However, the printing data may be captured in synchronization with either leading or trailing edge of CK. Further, the shift register may be constructed with a latch circuit employing a through latch instead of a flip-flop circuit which operates in synchronization with clock edges.

Similarly, the two 4-bit latch circuits 802 and 805 may be constructed with a flip-flop circuit in place of the latch circuit. The logic of the latch circuit may be a high-through. If a flip-flop structure is adopted, the condition for capturing signals may be a leading edge or trailing edge.

In the construction of the second embodiment, output signals N1 to N4 of the 2-to-4 decoder 806 and N5 to N8 of the 2-to-4 decoder 807 are inputted to the AND gates A1 to A64. However, signals inputted to one of the 2-to-4 decoders may be any of the signals B1L to B4L outputted by the 4-bit latch circuit 105. It should be noted that, as described above, unselected signals are inputted to the other 2-to-4 decoder.

Instead of providing the aforementioned AND circuit 803, AND may be calculated from the output signals N1 to N4, N5 to N8 of the 2-to-4 decoders 806 and 807 as well as enable signal ENB, then AND may be further calculated from the obtained AND and the output signals D1 to D4 of the 4-bit latch circuit 802 by the AND gates A1 to A64. Alternatively, 4 input terminals may be provided to the AND gates A1 to A64, and AND may be calculated from the output signals N1 to N4 of the 2-to-4 decoder 806, enable signal ENB, output signals N5 to N8 of the 2-to-4 decoder 807, and output signals D1 to D4 of the 4-bit latch circuit 802.

Furthermore, allocation of the printing signal and block control signal in the printing data DATA is not particularly limited, but any configuration may be adopted.

Other Embodiment

Although the foregoing embodiments are provided on an example of an inkjet printer, the present invention is widely applicable to a printhead which performs printing in accordance with a method other than the inkjet printing method, and a printer which performs printing by such printhead.

When the present invention is applied to a printer, a high-density, high-precision printing operation can be attained, if the printer comprises means (e.g., an electrothermal transducer, laser beam generator, and the like) for generating heat energy as energy utilized upon execution of ink discharge, and causes a change in state of an ink by the heat energy.

As the typical arrangement and principle of the ink-jet printing system, one practiced by use of the basic principle disclosed in, for example, U.S. Pat. Nos. 4,723,129 and 4,740,796 is preferable. The above system is applicable to either one of so-called an on-demand type and a continuous type. Particularly, in the case of the on-demand type, the system is effective because, by applying at least one driving signal, which corresponds to printing information and gives a rapid temperature rise exceeding nucleate boiling, to each of electrothermal transducers arranged in correspondence with a sheet or liquid channels holding a liquid (ink), heat energy is generated by the electrothermal transducer to effect film boiling on the heat acting surface of the printhead, and consequently, a bubble can be formed in the liquid (ink) in one-to-one correspondence with the driving signal. By discharging the liquid (ink) through a discharge opening by growth and shrinkage of the bubble, at least one droplet is formed. If the driving signal is applied as a pulse signal, the growth and shrinkage of the bubble can be attained instantly and adequately to achieve discharge of the liquid (ink) with the particularly high response characteristics.

As the pulse driving signal, signals disclosed in U.S. Pat. Nos. 4,463,359 and 4,345,262 are suitable. Note that further excellent printing can be performed by using the conditions described in U.S. Pat. No. 4,313,124 of the invention which relates to the temperature rise rate of the heat acting surface.

As an arrangement of the printhead, in addition to the arrangement as a combination of discharge nozzles, liquid channels, and electrothermal transducers (linear liquid channels or right angle liquid channels) as disclosed in the above specifications, the arrangement using U.S. Pat. Nos. 4,558,333 and 4,459,600, which disclose the arrangement having a heat acting portion arranged in a flexed region is also included in the present invention. In addition, the present invention can be effectively applied to an arrangement based on Japanese Patent Laid-Open No. 59-123670 which discloses the arrangement using a slot common to a plurality of electrothermal transducers as a discharge portion of the electrothermal transducers, or Japanese Patent Laid-Open No. 59-138461 which discloses the arrangement having an opening for absorbing a pressure wave of heat energy in correspondence with a discharge portion.

Furthermore, as a full line type printhead having a length corresponding to the width of a maximum printing medium which can be printed by the printer, either the arrangement which satisfies the full-line length by combining a plurality of printheads as disclosed in the above specification or the arrangement as a single printhead obtained by forming printheads integrally can be used.

In addition, not only an exchangeable chip type printhead, as described in the above embodiment, which can be electrically connected to the apparatus main unit and can receive an ink from the apparatus main unit upon being mounted on the apparatus main unit but also a cartridge type printhead in which an ink tank is integrally arranged on the printhead itself can be applicable to the present invention.

It is preferable to add recovery means for the printhead, preliminary auxiliary means, and the like provided as an arrangement of the printer of the present invention since the printing operation can be further stabilized. Examples of such means include, for the printhead, capping means, cleaning means, pressurization or suction means, and preliminary heating means using electrothermal transducers, another heating element, or a combination thereof. It is also effective for stable printing to provide a preliminary discharge mode which performs discharge independently of printing.

Furthermore, as a printing mode of the printer, not only a printing mode using only a primary color such as black or the like, but also at least one of a multi-color mode using a plurality of different colors or a full-color mode achieved by color mixing can be implemented in the printer either by using an integrated printhead or by combining a plurality of printheads.

Moreover, in each of the above-mentioned embodiments of the present invention, it is assumed that the ink is a liquid. Alternatively, the present invention may employ an ink which is solid at room temperature or less and softens or liquefies at room temperature, or an ink which liquefies upon application of a use printing signal, since it is a general practice to perform temperature control of the ink itself within a range from 30° C. to 70° C. in the ink-jet system, so that the ink viscosity can fall within a stable discharge range.

In addition, in order to prevent a temperature rise caused by heat energy by positively utilizing it as energy for causing a change in state of the ink from a solid state to a liquid state, or to prevent evaporation of the ink, an ink which is solid in a non-use state and liquefies upon heating may be used. In any case, an ink which liquefies upon application of heat energy according to a printing signal and is discharged in a liquid state, an ink which begins to solidify when it reaches a printing medium, or the like, is applicable to the present invention. In this case, an ink may be situated opposite electrothermal transducers while being held in a liquid or solid state in recess portions of a porous sheet or through holes, as described in Japanese Patent Laid-Open No. 54-56847 or 60-71260. In the present invention, the above-mentioned film boiling system is most effective for the above-mentioned inks.

The present invention can be applied to a system constituted by a plurality of devices (e.g., host computer, interface, reader, printer) or to an apparatus comprising a single device (e.g., copying machine, facsimile machine).

As many apparently widely different embodiments of the present invention can be made without departing from the spirit and scope thereof, it is to be understood that the invention is not limited to the specific embodiments thereof except as defined in the appended claims.

What is claimed is:

1. A printhead structured such that a plurality of printing elements arranged in a predetermined direction and a driving circuit driving the printing elements are provided on one substrate, and that the printing elements are divisionally driven in units of plural blocks, comprising:

an input terminal serially inputting printing data corresponding to each printing element and encoded block data designating a block to be driven;

a shift register sequentially shifting and storing one bit at a time the data serially inputted from said input terminal;

a latch temporarily storing the data stored in said shift register;

a decoder decoding the encoded block data among the data stored in said latch; and an AND circuit performing AND operation of the printing data outputted from said latch, an output of said decoder, and a driving signal designating driving timing of the driving circuit, wherein said decoder outputs a signal in which the encoded block data is partially decoded, said AND circuit determines a block to be driven based on the partially decoded signal, and a number of the output signal lines from said decoder is less than a number of the blocks.

2. The printhead according to claim 1, wherein said AND circuit comprises a first AND gate and a second AND gate, said first AND gate performs AND operation of the printing data and an enable signal designates driving timing of the driving circuit, and said second AND gate performs AND operation of an output of said first AND gate and the output of said decoder.

3. The printhead according to claim 1, wherein said AND circuit comprises an AND gate, to which all of the printing data, the output from said decoder, and the driving signal designating driving timing of the driving circuit are inputted.

4. The printhead according to claim 1, wherein said decoder decodes (n−1) bit, provided that a number of bits of the encoded block data is n, and outputs the remaining 1 bit and its reversed signal.

5. The printhead according to claim 1, wherein said decoder includes two decoders to decode n/2 bit, provided that the number of bits of the encoded block data is an even number n.

6. The printhead according to claim 1, wherein two sets of circuits are arranged symmetrically on the substrate, one set of circuits including said driving circuit, said input terminal, said shift register, said latch, said decoder, and said AND circuit.

7. The printhead according to claim 1, wherein said printhead is an inkjet printhead with performs printing by discharging ink.

8. The printhead according to claim 7, wherein said printhead discharges ink by utilizing heat energy, and the printing elements comprise electrothermal transducers to generate heat energy to be applied to ink.

9. The printhead according to claim 1, wherein a number of output signal lines from one decoder is less than the number of blocks.

10. The printhead according to claim 1, wherein a number of bits in an input signal to said decoder is less than a number of bits of the encoded block data received at said shift register.

11. The printhead according to claim 1, further comprising decoding means for decoding the encoded block data not being decoded by said decoder.

12. The printhead according to claim 11, wherein said AND circuit performs AND operation of the output of said decoder and an output of said decoding means.

13. The printhead according to claim 1, wherein said AND circuit determines the block to be driven by performing AND operation of the output of said decoder and a signal based on the encoded block data not being decoded by said decoder.

14. A printhead substrate structured such that a plurality of printing elements arranged in a predetermined direction and a driving circuit driving the printing elements are provided on one substrate, and that the printing elements are divisionally driven in units of plural blocks, comprising:

an input terminal serially inputting printing data corresponding to each printing element and encoded block data designating a block to be driven;

a shift register sequentially shifting and storing one bit at a time the data serially inputted from said input terminal;

a latch temporarily storing the data stored in said shift register;

a decoder decoding the encoded block data among the data stored in said latch; and an AND circuit performing AND operation of the printing data outputted from said latch, an output of said decoder, and a driving signal designating driving timing of the driving circuit, wherein said decoder outputs a signal in which the encoded block data is partially decoded, said AND circuit determines a block to be driven based on the partially decoded signal, and a number of output signal lines from said decoder is less than a number of the blocks.

15. The printhead substrate according to claim 14, wherein said AND circuit determines the block to be driven by performing AND operation of the output of said decoder and a signal based on the encoded block data not being decoded by said decoder.

16. A printing apparatus utilizing a printhead structured such that a plurality of printing elements arranged in a predetermined direction and a driving circuit driving the printing elements are provided on one substrate, and that the printing elements are divisionally driven in units of plural blocks, said printhead comprising:

an input terminal serially inputting printing data corresponding to each printing element and encoded block data designating a block to be driven;

a shift register sequentially shifting and storing one bit at a time the data serially inputted from said input terminal;

a latch temporarily storing the data stored in said shift register;

a decoder decoding the encoded block data among the data stored in said latch; and an AND circuit performing AND operation of the printing data outputted from said latch, an output of said decoder, and a driving signal designating driving timing of the driving circuit, wherein said decoder outputs a signal in which the encoded block data is partially decoded, said AND circuit determines a block to be driven based on the partially decoded signal, and a number of output signal lines from said decoder is less than a number of the blocks.

17. The printing apparatus according to claim 16, wherein a signal input to said printhead is controlled so that a period during which a signal is inputted to said input terminal and a driving period of the driving circuit are at least partially overlapped.

18. The printing apparatus according to claim 16, wherein said AND circuit determines the block to be driven by performing AND operation of the output of said decoder and a signal based on the encoded block data not being decoded by said decoder.

19. A printhead structured such that a plurality of printing elements arranged in a predetermined direction and a driving circuit driving the printing elements are provided on one substrate, where the printing elements are divisionally driven in units of plural blocks, comprising:

an input portion inputting serial printing data corresponding to each printing element, and inputting serial encoded block data designating a block to be driven;

a shift register circuit sequentially shifting and storing one bit at a time the data serially inputted from said input portion;

a latch circuit temporarily storing the data stored in said shift register circuit;

a decoder circuit decoding the encoded block data from among the data stored in said latch circuit; and an AND circuit performing AND operation of the printing data outputted from said latch circuit, an output of said decoder circuit, and a driving signal designating driving timing of the driving circuit, wherein said decoder circuit outputs a signal in which the encoded block data is partially decoded, said AND circuit determines a block to be driven based on the partially decoded signal, and a number of output signal lines from said decoder is less than a number of the blocks.

20. The printhead according to claim 19, wherein said AND circuit comprises a first AND gate and a second AND gate, said first AND gate performs AND operation of the printing data and an enable signal designating driving timing of the driving circuit, and said second AND gate performs AND operation of an output of said first AND gate and the output of said decoder circuit.

21. The printhead according to claim 19, further comprising decoding means for decoding the encoded block data not being decoded by said decoder circuit.

22. The printhead according to claim 21, wherein said AND circuit performs AND operation of the output of said decoder circuit and an output of said decoding means.

* * * * *

UNITED STATES PATENT AND TRADEMARK OFFICE

CERTIFICATE OF CORRECTION

PATENT NO. : 6,729,708 B2
APPLICATION NO. : 10/127452
DATED : May 4, 2004
INVENTOR(S) : Yasuo Fujii It is certified that error appears in the above-identified patent and that said Letters Patent is hereby corrected as shown below:

COLUMN 3:

Line 37, “an yield” should read --a yield--.

COLUMN 4:

Line 41, “An” should read --A--.
Line 45, “an” should read --a--.
Line 46, “of an” (both occurrences) should read --of a--.
Line 47, “an” should read --a--.
Line 50, “an” should read --a--.

COLUMN 7:

Line 43, “circuit” should read --circuits--.

COLUMN 10:

Line 47, “circuit” should read --circuits--.

Signed and Sealed this

Thirty-first Day of July, 2007

JON W. DUDAS
*Director of the United States Patent and Trademark Office*

UNITED STATES PATENT AND TRADEMARK OFFICE

CERTIFICATE OF CORRECTION

PATENT NO. : 6,729,708 B2
APPLICATION NO. : 10/127452
DATED : May 4, 2004
INVENTOR(S) : Yasuo Fujii It is certified that error appears in the above-identified patent and that said Letters Patent is hereby corrected as shown below:

COLUMN 3:

Line 37, “an yield” should read --a yield--.

COLUMN 4:

Line 41, “An” should read --A--.
Line 45, “an” should read --a--.
Line 46, “of an” (both occurrences) should read --of a--.
Line 47, “an” should read --a--.
Line 50, “an” should read --a--.

COLUMN 7:

Line 43, “circuit” should read --circuits--.

COLUMN 10:

Line 47, “circuit” should read --circuits--.

Signed and Sealed this

Twenty-first Day of August, 2007

JON W. DUDAS
*Director of the United States Patent and Trademark Office*